US007723627B2

(12) United States Patent
Hotta et al.

(10) Patent No.: US 7,723,627 B2
(45) Date of Patent: May 25, 2010

(54) EL SHEET AND MEMBER FOR LIGHTING PUSH-BUTTON SWITCH

(75) Inventors: Shinji Hotta, Kodama-gun (JP); Shunichi Yamada, Hakodate (JP)

(73) Assignee: Shin-Etsu Polmyer Co., Ltd., Tokyo (JP)

( * ) Notice: Subject to any disclaimer, the term of this patent is extended or adjusted under 35 U.S.C. 154(b) by 488 days.

(21) Appl. No.: 10/585,002

(22) PCT Filed: Feb. 16, 2005

(86) PCT No.: PCT/JP2005/002315

§ 371 (c)(1),
(2), (4) Date: Jun. 29, 2006

(87) PCT Pub. No.: WO2005/079120

PCT Pub. Date: Aug. 25, 2005

(65) Prior Publication Data

US 2008/0029373 A1 Feb. 7, 2008

(30) Foreign Application Priority Data

Feb. 18, 2004 (JP) ..... 2004-041707
Mar. 12, 2004 (JP) ..... 2004-069953
Jul. 7, 2004 (JP) ..... 2004-200042

(51) Int. Cl.
*H01H 9/00* (2006.01)

(52) U.S. Cl. ..... 200/314; 362/84

(58) Field of Classification Search ..... 200/314
See application file for complete search history.

(56) References Cited

U.S. PATENT DOCUMENTS 5,346,752 A 9/1994 Sawada et al.
5,770,920 A 6/1998 Eckersley et al.
5,777,038 A 7/1998 Nishikawa et al.
5,871,088 A * 2/1999 Tanabe ..... 200/514

(Continued)

FOREIGN PATENT DOCUMENTS

CN 1233350 A 10/1999

(Continued)

*Primary Examiner*—Michael A Friedhofer
*Assistant Examiner*—Lheiren Mae A Anglo
(74) *Attorney, Agent, or Firm*—Wenderoth, Lind & Ponack, L.L.P.

(57) ABSTRACT

An EL sheet and a member for lighting a push-button switch capable of emitting light stably and sufficiently for a long period of time without trouble such as non-light emission phenomena and generation of black dot, even if the EL element is subjected to, for example, a drawing process to form into a three dimensional shape, includes a counter electrode layer 15, dielectric layer 14, light-emitting layer 13, and transparent electrode layer 11. An adhesive layer 12 made of adhesive having excellent adhesiveness to the electroconductive polymer is disposed between the transparent electrode layer 11 made of an electroconductive polymer and the light-emitting layer 13. As for the adhesives having excellent adhesiveness, polyester, acrylic, cyanoacrylate, polyolefin, ethylene-vinyl acetate or ethylene ethyl acrylate type adhesive is used. The dielectric layer is made of fluoro type, polyester type or acrylic type resin binder. Furthermore, to improve durability in hot and high humidity environment, a second counter electrode layer 17 and/or a second dielectric layer 17, both having an ion diffusion-preventing function, is/are disposed.

23 Claims, 4 Drawing Sheets

U.S. PATENT DOCUMENTS

| | | | | |
|---|---|---|---|---|
| 6,245,175 | B1 | 6/2001 | Hotta et al. | |
| 6,373,008 | B1 * | 4/2002 | Saito et al. | 200/310 |
| 6,432,516 | B1 | 8/2002 | Terasaki et al. | |
| 6,445,128 | B1 | 9/2002 | Bush et al. | |
| 6,595,653 | B2 * | 7/2003 | Saito et al. | 362/84 |
| 6,858,811 | B2 * | 2/2005 | Fitzgerald et al. | 200/85 R |
| 6,936,783 | B2 | 8/2005 | Kawaguchi et al. | |
| 7,399,519 | B2 * | 7/2008 | Fang et al. | 428/196 |
| 7,399,937 | B2 * | 7/2008 | Nishimura | 200/314 |
| 7,407,708 | B2 * | 8/2008 | Amari et al. | 428/422 |
| 2002/0031688 | A1 | 3/2002 | Tanabe et al. | |

FOREIGN PATENT DOCUMENTS

| | | |
|---|---|---|
| CN | 1321405 | 11/2001 |
| JP | 5-8306 | 1/1993 |
| JP | 8-161935 | 6/1996 |
| JP | 10-188718 | 7/1998 |
| JP | 11-2812 | 1/1999 |
| JP | 11-508081 | 7/1999 |
| JP | 11-273874 | 10/1999 |
| JP | 2000-285760 | 10/2000 |
| JP | 2001-307886 | 11/2001 |
| JP | 2001-319786 | 11/2001 |
| JP | 2002-15872 | 1/2002 |
| JP | 2002-50475 | 2/2002 |
| JP | 2002-367469 | 12/2002 |
| JP | 2003-507868 | 2/2003 |
| JP | 2003-249349 | 9/2003 |
| JP | 2004-6105 | 1/2004 |
| WO | 98/07216 | 2/1998 |
| WO | 01/15496 | 3/2001 |
| WO | 02/080627 | 10/2002 |
| WO | 02/097837 | 12/2002 |

* cited by examiner

PRIOR ART

EL SHEET AND MEMBER FOR LIGHTING PUSH-BUTTON SWITCH

TECHNICAL FIELD

The present invention relates to a member for lighting a push-button switch and an EL sheet for the member, which are used for mobile communication devices such as cell phones, PDA, etc., CD players, MD players, small-sized tape recorders, etc., or for small-sized electric equipments mounted on motor vehicles.

BACKGROUND ART

Heretofore, the illuminated-type push-button switch has been utilized for an input unit of a mobile communication device, etc. In the member for lighting a push-button switch of this type for input units, lighting functions which act as illumination function to illuminate a function display portion of the push-button switch at night-time are widely used.

FIG. 2 shows an example of a conventional illuminated-type push-button switch. As shown in FIG. 2, in the conventional push-button switch used for an input unit of a cell phone, etc., a cover base 32, which is formed in one body with a key top portion 31 that constitutes an operation key, and a circuit board 33 are disposed in a face-to-face manner and assembled in a housing of the input unit, so as to realize a switching function of the push-button switch 30. The push-button switch 30 has a display portion 34.

On the circuit board 33, a light source such as LED 35, etc., is provided. Light from the light source or reflected light thereof goes from an underside portion to an upper surface portion of the key top portion 31, so that even at night-time a display of the cell phone can be visually recognized easily.

The applicants of the present application already filed a patent application relating to a push-button switch member whose display portion is illuminated without such trouble as uneven brightness, with smaller power consumption, thinner in thickness and lighter in weight and method for manufacturing the same. It has a built-in EL element made from electroluminescent material. (Japanese patent publication JP-A-2002-367469).

In another prior art, an illuminated type sheet-like key top is disclosed. It comprises a light-transmitting resin film on a body of a key top portion, an organic polymer layer as a transparent electrode layer on a lower surface of the resin film, a compensating electrode layer, a light-emitting layer, a dielectric layer, a counter electrode layer and an insulation layer (Japanese Patent Publication JP-A-2000-285760).

In still another prior art, a push-button switch member for an input unit of cell phone, etc., has an illuminating display portion disposed on an upper surface side of the key top. And an EL sheet having a self-emitting type sheet-like light-emitting portion is used at the display portion. The push-button switch member with such EL sheet can be obtained by forming the EL sheet into a key top shape. The EL sheet has the sheet-like light emitting portion comprising a transparent electrode layer having an electroconductive polymer of a colored layer formed on a transparent insulation film, a light-emitting layer made of inorganic EL, etc., a dielectric layer and a counter electrode layer. All layers are laminated in this order. (Japanese patent publication JP-A-2004-6105).

SUMMARY OF THE INVENTION

Problems to be Solved by the Invention

An EL element used for a push-button switch member comprises a transparent electrode layer, light-emitting layer, dielectric layer and a counter electrode layer, and a thin layer of indium oxide-tin oxide (ITO) is generally used as the transparent electrode layer. The thin ITO layer is a glassy material so that it tends to cause disconnection when a certain level of tensile stress is applied, being poor in three dimensional formability. Push-button switch members for cell phones, etc., are often subjected to severe molding processes in order to form them into required complicated three-dimensional designs. Therefore an electroconductive polymer, which is not likely to cause electric disconnection when tensile stress is applied, is selected as a material of the transparent electrode layer when drawing process is used for three dimensional shaping process.

Electroconductive polymer, however, is usually poor in adhesiveness, and accordingly peeling at each interface tends to be caused by residual stress generated and remained in the EL sheet when the EL sheet made of electroconductive polymer is shaped into a three dimensional shape using a drawing process. Especially, when severely shaped, peeling might happen between the transparent electrode layer and the light-emitting layer, where bonding strength between them is not so excellent, causing troubles of partial non-light emission phenomenon of the EL element, which is a problem to be solved.

A fluorocarbon type resin binder is poor in adhesiveness. Therefore, a cyanoethyl type binder, which gives excellent adhesiveness, is often used for a binder for the light-emitting layer or the dielectric layer. The cyanoethyl type binder, however, has a hygroscopic property so that the light-emitting layer or the dielectric layer absorbs moisture, causing such phenomena as non-light emission or black dot. In this document, the black dot means a color change caused by short circuit, etc. The non-light emission and the black dot phenomena, which occur at the dielectric layer, the light-emitting layer, the transparent electrode layer, etc., are presumed to be caused by an impurity ion in the transparent electrode, the luminescent material (zinc sulfide coated with alumina or silicon oxide), the dielectric substance and the binder.

In the EL sheet used for a conventional push-button switch member, an impurity such as metal filler in the counter electrode layer, bromine and chlorine in the transparent electrode layer, etc., are ionized and diffused as the light emitting time of EL sheet passes. Consequently, deterioration is seen in insulation property between the transparent electrode layer and a back electrode layer and furthermore such disadvantage as non-light emission phenomenon, etc., occurs. These phenomena are further accelerated under a high-humidity environment.

The present invention is to provide an EL sheet and a member for lighting a push-button switch, which is capable of emitting light stably and sufficiently for a long period of time without such trouble as non-light emission phenomena and generation of the black dot even if the EL element is made by a drawing process, for example, to form a 3 dimensional shape, and to provide an excellent environment-resistance illuminated-type push-button switch member capable of maintaining insulation property at its emitting region and capable of emitting light stably as originally designed even under a high moisture environment.

Means to Solve the Problems

The above mentioned problems can be solved by an EL sheet described in accordance with a first aspect of the present invention, which comprises:

a counter electrode layer;

a dielectric layer;

a light-emitting layer;

a transparent electrode layer made of an electroconductive polymer; and a sheet base member, wherein a light-transmitting adhesive layer excellent in adhesiveness to the electroconductive polymer is disposed between the transparent electrode layer made of the electroconductive polymer and the light-emitting layer.

A second aspect of the present invention is characterized in that in addition to the first aspect of the present invention, a light-transmitting adhesive layer excellent in adhesiveness to the electroconductive polymer is disposed between the transparent electrode layer made of the electroconductive polymer and the sheet base member.

A third or fourth aspects of the present invention are characterized in that in addition to the scope of claim 1 or 2, the light-transmitting adhesive layer excellent in adhesiveness to the electroconductive polymer is comprised of at least one resin-base binder selected from a group consisting of a polyester-base binder, an acrylic binder, a cyanoacrylate-base binder and an ethylene-vinyl acetate-base binder, or a synthetic rubber-base binder represented by urethan.

A fifth through eighth aspects of the present invention are characterized in that in addition to any one of scopes of claims 1 to 4, fluororesin is used as a binder for at least either the dielectric layer or the light-emitting layer.

A ninth through twelfth aspects of the present invention are characterized in that in addition to any one of scopes of the first through fourth aspects of the present invention, a polyester-base resin or an acrylic resin is used as a binder for the light-emitting layer, and fluorineresin is used as a binder for the dielectric layer.

A thirteenth to twenty-fourth aspects of the present invention are characterized in that in addition to any one of scopes of the first through twelfth aspects of the present invention, ion-exchange material is dispersed in at least one of the counter electrode layer, the dielectrode layer, the light-emitting layer, the transparent electrode layer made of electroconductive polymer and the light-transmitting adhesive layer.

A twenty-fifth aspect of the present invention are characterized in that a member for lighting a push-button switch comprises the EL sheet according to any one of the first through twenty-fourth aspects of the present invention, a portion of the EL sheet being formed into a convex shape projecting from a rear side near the counter electrode layer to the top side near the transparent electrode layer, and a core material having a key top shape which is inserted into the concave portion of the rear side of the convex shape.

A twenty-sixth aspect of the present invention is characterized in that any one of EL sheets according to the first through twenty-fourth aspects of the present invention is used, and at least one second counter electrode layer is further provided between the transparent electrode layer and the counter electrode layer, and the second counter electrode layer comprises a synthetic resin and an electroconductive filler comprising nickel or carbon as a main ingredient and being dispersed in the synthetic resin, the second counter electrode layer being disposed in contact with the counter electrode layer.

A twenty-seventh aspect of the present invention is characterized in that anyone of EL sheets according to the first through twenty-fourth aspects of the present invention is used, and at least one second dielectric layer is further provided between the transparent electrode layer and the counter electrode layer, the second dielectric layer comprising a synthetic resin and a dielectric substance having a dielectric constant lower than that of a dielectric substance used in the dielectric layer. And the second dielectric layer is disposed in contact with the dielectric layer.

A twenty-eighth aspect of the present invention is characterized in that any one of EL sheets according to the first through twenty-fourth aspects of the present invention is used, and at least one second counter electrode layer is further provided between the transparent electrode layer and the counter electrode layer, and the second counter electrode layer comprises a synthetic resin and an electroconductive filler comprising nickel or carbon as a main ingredient and being dispersed in the synthetic resin. The second counter electrode layer is disposed in contact with the counter electrode layer. At least one second dielectric layers is further provided between the transparent electrode layer and the counter electrode layer, the second dielectric layer comprising a synthetic resin and a dielectric substance having a dielectric constant lower than that of a dielectric substance used in the dielectric layer, the second dielectric layer being disposed in contact with dielectric layer.

A twenty-ninth aspect of the present invention is characterized in that an EL sheet comprises a counter electrode layer, a dielectric layer, a light-emitting layer, a transparent electrode layer made of an electroconductive layer, and a sheet base member, wherein a binder for the light-emitting layer is a binder different from that for the dielectric layer and is excellent in adhesiveness to the electroconductive polymer.

A thirtieth aspect of the present invention is characterized in that in addition to the twenty-ninth aspect of the present invention, a light-transmitting adhesive layer excellent in adhesiveness to the electroconductive polymer is disposed between the transparent electrode layer made of the electroconductive polymer and the sheet base member.

A thirty-first through thirty-second aspects of the present invention are characterized in that in addition to the twenty-ninth or thirtieth aspects of the present invention, the binder for the light-emitting layer is at least one resin-base binder selected from a group consisting of a polyester-base binder, an acrylic binder, a cyanoacrylate-base binder and an ethylene-vinylacetate-base binder, or a synthetic rubber-base binder represented by urethane.

A thirty-third through thirty-sixth aspects of the present invention are characterized in that a binder used for the dielectric layer is a fluororesin binder.

A thirty-seventh through fortieth aspects of the present invention are characterized in that in addition to the twenty-ninth through thirty-second aspects of the present invention, an ion-exchange material is dispersed in at least one of the counter electrode, the dielectric layer, the light-emitting layer, the transparent electrode layer made of electroconductive polymer and the light-transmitting adhesive layer excellent in adhesiveness to the electroconductive polymer.

A forty-first aspect of the present invention is characterized in that a member for lighting a push-button switch comprises an EL sheet according to any one of the twenty-ninth through fortieth aspects of the present invention, a portion of the EL sheet being formed into a convex shape projecting from a rear side near the counter electrode layer to a top side near the transparent electrode layer, and a core material having a key top shape which is inserted into a concave portion of the rear side of the convex shape.

A forty-second aspect of the present invention is characterized in that an EL sheet according to any one of the twenty-ninth through fortieth aspects of the present invention further comprises at least one second counter electrode layer disposed between the transparent electrode layer and the counter electrode layer, the second counter electrode layer comprising a synthetic resin and a conductive filler which comprises nickel or carbon as a main ingredient and is dispersed in the synthetic resin, the second counter electrode layer being disposed in contact with the counter electrode layer.

A forty-third aspect of the present invention is characterized in that an EL sheet according to any one of the twenty-ninth through fortieth aspects of the present invention further comprises at least one second dielectric layer between the transparent electrode layer and the counterelectrode layer, the second dielectric layer comprising a synthetic resin and a dielectric substance having a dielectric constant lower than that of a dielectric substance used in the dielectric layer, the second dielectric layer being disposed in contact with the dielectric layer.

A forty-fourth aspect of the present invention is characterized in that an EL sheet according to any one of the twenty-ninth through fortieth aspects of the present invention further comprises at least one second counter electrode layer disposed between the transparent electrode layer and the counter electrode layer, the second counter electrode layer comprising a synthetic resin and a conductive filler which comprises nickel or carbon as a main ingredient and is dispersed in the synthetic resin, the second counter electrode layer being disposed in contact with the counter electrode layer, and at least one second dielectric layer being disposed between the transparent electrode layer and the counter electrode layer, the second dielectric layer comprising a synthetic resin and a dielectric substance having a dielectric constant lower than that of a dielectric substance used in the dielectric layer, the second dielectric layer being disposed in contact with the dielectric layer.

EFFECTS OF THE INVENTION

These inventions mentioned above can provide an EL sheet having an EL element, which has an excellent moisture resistance and is capable of stably illuminating for a long period of time without occurrence of non-light emission phenomenon and black dot even after the EL sheet is formed into a three-dimensional shape by, for example, drawing process, etc. The present invention can also provide a member for lighting a push-button switch having such properties described above.

In particular, the first through fourth aspects of the present invention can give an excellent bonding strength not only between the transparent electrode layer and the light-emitting layer but also between the transparent electrode layer and the sheet base member, and can prevent the EL sheet from occurring uneven light emission or non-light emission phenomenon caused by delamination of the layers or an increase in resistance.

According to the fifth through eighth aspects of the present invention, in addition to the effects of any one of the first through fourth aspects of the present invention, insulation deterioration and an electrochemical reaction which causes migration, degradation, combination, etc., can be suppressed because moisture absorption into the dielectric layer, the light-emitting layer or both of them and their neighborhood binders is limited. Accordingly the EL sheet becomes excellent in environment resistance and has a long illumination life.

The i ninth through twelfth aspects of the present invention have, in addition to the effects of any one of the first through fourth aspects of the present invention, an effect in improving adhesiveness between the dielectric layer, the light-emitting layer or both of them and their neighboring binders, accordingly allowing the EL sheet to have an excellent formability and flexibility, and have a low driving load due to a decrease in electric capacitance of the light-emitting layer because of a decrease in the dielectric constant.

The thirtieth through twenty-four aspects of the present invention have, in addition to the effects of anyone of the first through twelfth aspects of the present invention, an effect of suppressing electrochemical reaction which causes insulation deterioration, migration, degradation, chemical combination, etc., because ion-exchange material in the EL sheet can selectively capture ions generated in the EL element, accordingly allowing the EL sheet to have an excellent environmental resistance and a long illumination life.

The twenty-fifth aspect of the present invention can provide a member for lighting a push-button switch having the effects described in the first through twenty-fourth aspects of the invention.

The twenty-sixth aspect of the present invention can, in addition to the effects of any one of the first through twenty-fourth aspects of the present invention, provide an EL sheet which can stably emit light with an originally designed brightness (intensity) for a long period of time due to the presence of the second counter electrode layer provided between the transparent electrode layer and the counter electrode layer. The second counter electrode layer prevents ionization of impurities such as metal filler in the counter electrode layer or bromine, chlorine, etc., in the transparent electrode layer and previously prevents diffusion of the resulting ions, thereby maintaining insulation properties of a portion corresponding to the emitting region between the transparent electrode layer and the counter electrode layer.

The twenty-seventh aspect of the present invention can, in addition to the effects of any one of the first through twenty-fourth aspects of the present invention, provide an EL sheet which can stably emit light with an originally designed brightness for a long period of time due to the presence of the second dielectric layer provided between the transparent electrode layer and the counter electrode layer. The second dielectric layer prevents ionization of impurities such as metal filler in the counter electrode layer or bromine, chlorine, etc., in the transparent electrode layer and previously prevents diffusion of the resulting ions, thereby maintaining insulation property of a portion corresponding to the emitting region between the transparent electrode layer and the counter electrode layer.

The twenty-eighth aspect of the present invention can, in addition to the effects of any one of the first through the twenty-fourth aspects of the present invention, provide an EL sheet which can stably emit light with an originally designed brightness for a long period of time due to the presence of the second counter electrode layer and the second dielectric layer provided between the transparent electrode layer and the counter electrode layer. The second counter electrode layer and the second dielectric layer strongly prevents ionization of impurities such as metal filler in the counter electrode layer or bromine, chlorine, etc., in the transparent electrode layer and prevents diffusion of the resulting ions, thereby maintaining insulation properties of a portion corresponding to the emitting region between the transparent electrode layer and the counter electrode layer.

The twenty-ninth through the thirty-second aspect of the present invention can provide a molded EL sheet with less uneven light emission and non-light emission phenomena because bonding strength between the transparent electrode layer and the light-emitting layer and/or the sheet base member is improved. And delamination of these layers and an increase in electric resistance are suppressed when the EL sheet is subjected to various stresses when molded.

The thirty-third through thirty-sixth aspects of the present invention have, in addition to the effects of any one of the twenty-ninth through thirty-second aspects of the present invention, an effect of suppressing an electrochemical reaction which causes insulation deterioration, migration, degradation, chemical combination, etc., because the dielectric layer and the binder in the vicinity of the dielectric layer become less hygroscopic, accordingly allowing the EL sheet to have an excellent environmental resistance and a long illumination life.

The thirty-seventh through fortieth aspects of the present invention have, in addition to the effects of any one of the twenty-ninth through thirty-second aspects of the present invention, an effect of suppressing electrochemical reaction which causes insulation deterioration, migration, degradation, chemical combination, etc., when ions are generated in the EL element, because ion-exchange material selectively traps ions. Accordingly the EL sheet has an excellent environmental resistance and a long illumination life.

The forty-first aspect of the present invention can provide a member for lighting a push-button switch having the effects described in the twenty-ninth through fortieth aspects of the present invention.

The forty-second aspect of the present invention can, in addition to the effects of any one of the twenty-ninth through fortieth aspects of the present invention, provide an EL sheet which can stably emit light with an originally designed brightness for a long period of time due to the presence of the second counter electrode layer provided between the transparent electrode layer and the counter electrode layer. The second counter electrode layer prevents ionization of impurities such as metal filler in the counter electrode layer, or bromine, chlorine, etc., in the transparent electrode layer and prevents diffusion of the resulting ions, thereby maintaining insulation properties of a portion corresponding to the emitting region between the transparent electrode layer and the counter electrode layer.

The forty-third aspect of the present invention can, in addition to the effects of any one of the twenty-ninth through fortieth aspects of the present invention, provide an EL sheet which can stably emit light with an originally designed brightness for a long period of time due to the presence of the second dielectric layer provided between the transparent electrode layer and the counter electrode layer. The second dielectric layer prevents ionization of impurities such as metal filler in the counter electrode layer, or bromine, chlorine, etc., in the transparent electrode layer and previously prevents diffusion of the resulting ions, thereby maintaining insulation properties of a portion corresponding to the emitting region between the transparent electrode layer and the counter electrode layer.

The forty-fourth aspect of the present invention has, in addition to the effects of any one of the twenty-ninth through fortieth aspects of the present invention, an effect of providing an EL sheet which can stably emit light with an originally designed brightness for a long period of time due to the presence of the counter electrode layer and the second dielectric layer provided between the transparent electrode layer and the counterelectrode layer. The counterelectrode layer and the second dielectric layer prevent ionization of impurities such as metal filler in the counterelectrode layer, or bromine, chlorine, etc., in the transparent electrode layer and previously much strongly prevent diffusion of the resulting ions, thereby maintaining insulation properties of a portion corresponding to the emitting region between the transparent electrode layer and the counter electrode layer.

DETAILED DESCRIPTION OF PREFERRED EMBODIMENTS

Embodiments according to the first through twenty-fifth or twenty-ninth through forty-first aspects of the present invention will be explained hereunder with reference to FIG. 1.

Figure 1:
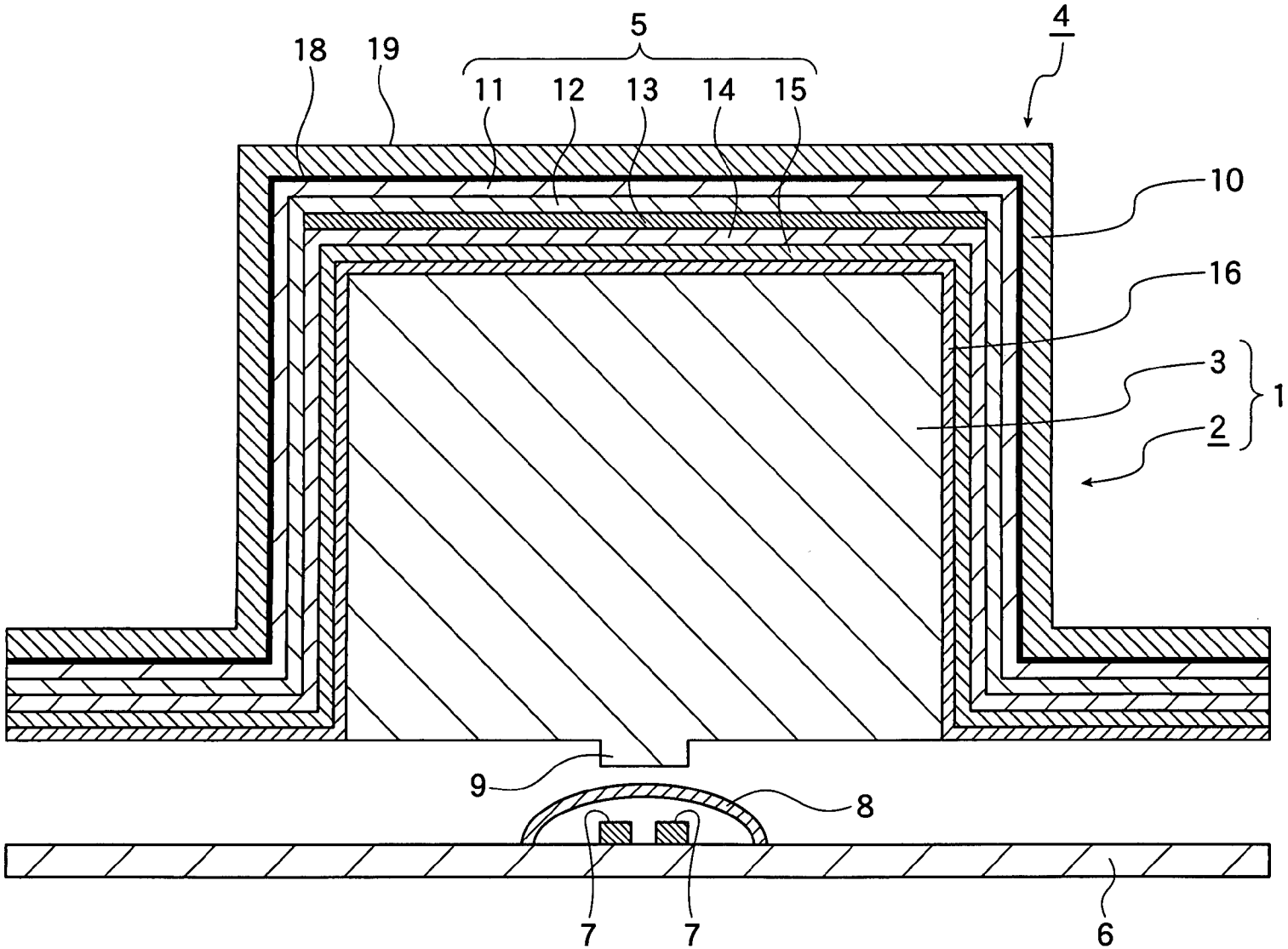
FIG. 1 is a sectional view showing an essential portion of the best mode of a member for lighting a push-button switch according to the present invention.
Figure 2:
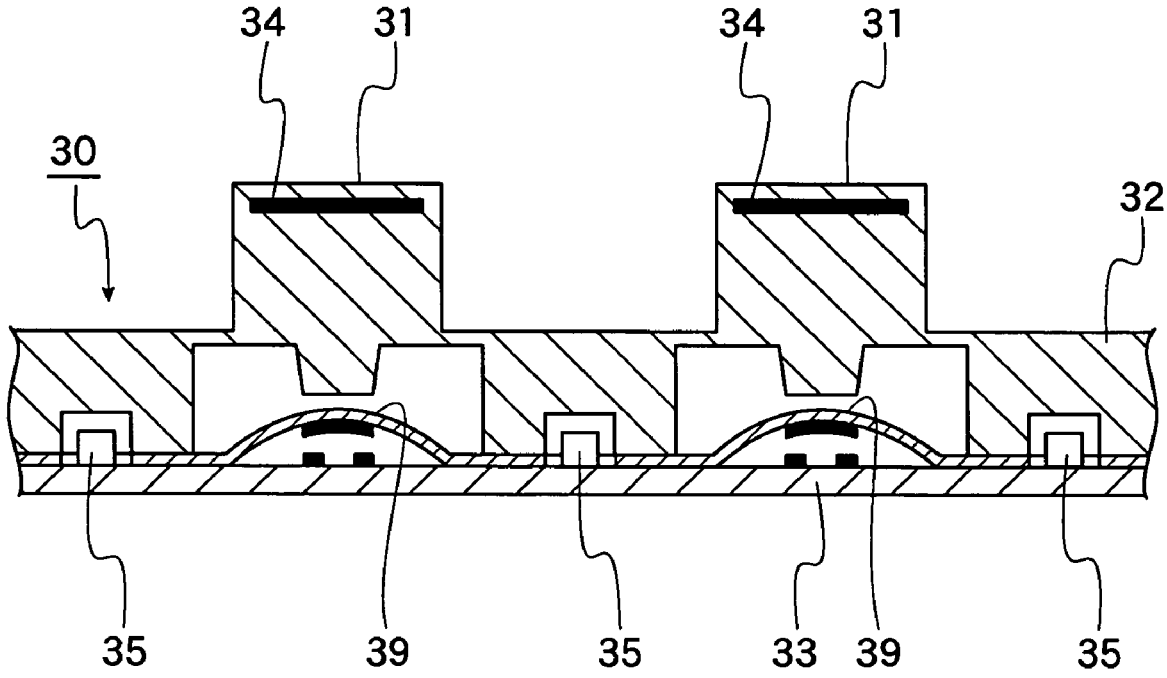
FIG. 2 is a sectional view showing a conventional illuminated-type push-button switch.

FIG. 1 is a sectional view showing an essential portion of a switch provided with a member for lighting a push-button switch 1 of the first through twenty-fifth or twenty-ninth through forty-first aspects of the present invention.

The member for lighting a push-button switch 1 of the embodiment shown in FIG. 1 comprises an EL sheet 2 and a core material 3. A key top portion 4 is formed by filling the core material 3 into the reverse side of the EL sheet 2. A sheet-like light-emitting portion 5 is provided at an upper surface portion 19 of the EL sheet 2.

The member for lighting a push-button switch 1 is provided over a circuit board 6. The circuit board 6 has a pair of fixed contacts 7 that are usually covered by a dome-shaped disc spring 8 made of metal. At a lower edge of the key top portion 4, a pressing protrusion 9 is provided. When the key top portion 4 is pressed toward the circuit board 6, the pressing protrusion 9 pushes the disc spring 8 so that the pair of fixed contacts 7 are electrically connected.

In the key top portion 4, if necessary, a cover base material made of an elastic material such as silicone rubber, etc., can be used. The cover base material has elasticity and is sealed at an outer circumference thereof.

An outermost periphery of the key top portion 4 is made of a transparent insulation film 10 as a sheet-like base material. On a reverse side of the transparent insulation film 10, a transparent electrode layer 11 as one electrode is formed. On a reverse side of the transparent electrode layer 11, a light-emitting layer 13 is laminated by way of a light-transmitting adhesive layer 12. The light-transmitting layer 13 is only formed at a sheet-like light-emitting portion 5 of the key top portion 4.

On a reverse side of the light-emitting layer 13, a dielectric layer 14 is formed. And on a reverse side of the dielectric layer 14, a counter electrode layer 15 as the other electrode is formed. The sheet-like light-emitting portion 5 is comprised of the transparent electrode layer 11, light-transmitting adhesive layer 12, the light-emitting layer 13, the dielectric layer 14 and the counter electrode layer 15. On the reverse side of the transparent electrode layer 11 outside the sheet-like light-emitting portion 5, the dielectric layer 14 is laminated by way of the light-transmitting adhesive layer 12.

The EL sheet 2 has a film adhesive layer 16 at a reverse side of the counter electrode layer 15 of the sheet-like light-emitting portion 5. The EL sheet 2 is formed into a convex shape protruding from the counter electrode layer 15 on which the film adhesive layer 16 is provided toward the transparent electrode layer 11 on which the transparent insulation film 10 is provided. At a reverse side of the convex portion, the core material 3 is filled to form the member for lighting a push-button switch 1. The shape of the key top portion 4 is mainly determined by the shape of the core material 3.

Resins such as polyethylene terephthalate, polybutylene terephthalate, polycarbonate, polystyrene, polyimide, polyamide, polyphenylene sulfide, acrylic resins, etc., can be used as the transparent insulation film 10 at the outer periphery of the key top portion 4. Homopolymers, copolymers or modified polymers as well as polymer alloys thereof can be used for such resins. Further, various thermoplastic elastomers such as styrenic or polyester type polymers can be exemplified. Preferably polycarbonate type alloy film having a thickness of 12 to 500 μm is exemplified. Furthermore, a decorative layer having such a character, numeric character, symbolic design etc., (not illustrated) can be provided on the transparent insulation film 10.

A transparent electroconductive polymer is used for the transparent electrode layer 11 on the reverse side of the transparent insulation film 10. Polypyrrole, polythiophen, polyaniline or derivatives thereof can be preferably used for the electroconductive polymer. These polymers are preferably used because they are transparent and have a high electroconductivity.

Reliability of adhesive bonding can be enhanced by providing an adhesive layer 18 excellent in light-transmission between the transparent insulation film 10 and the transparent electrode layer 11. As the light-transmitting adhesive layer, a binder having adhesiveness to the transparent electrode layer can be used. More specifically, a polyester type, acrylic type, cyanoacrylate type, polyolefin type, ethylene-vinyl acetate type, ethylene-ethyl acrylate type resin or a copolymer thereof, or a synthetic rubber such as urethane rubber, butyl rubber, etc., are exemplified.

When the light-transmitting adhesive layer 18 is disposed, adhesiveness between the electroconductive polymer and the transparent insulation film 10 or the decorative layer is improved, enhancing reliability of resistance to peeling of the two layers after three-dimensional molding. Material for the light-transmitting adhesive layer 18 is the same material used as a light-transmitting adhesive layer 12, as described later, which is disposed between the transparent electrode layer 11 and the light-emitting layer 13.

Thermoplastic resin having an excellent adhesiveness to the electroconductive polymer can be used as the transparent adhesive layer 12.

As the thermoplastic resins, polyacrylonitrile, polyester, urethane type resin, polyethylene resin, polystyrene resin, polymethyl methacrylate, polyether, polycarbonate, polyamide, diene type resin, vinylidene chloride resin, polyvinyl chloride, polyvinyl ether, polyvinyl ketone and compounds thereof.

When the transparent adhesive layer 12 is formed with the above mentioned thermoplastic resin, hardness of the transparent adhesive layer 12 can be reduced so that elongatability thereof can be improved.

Accordingly, the EL sheet can endure bending and elongation when the EL sheet undergoes a drawing process. Thus generation of cracks, breakage or delamination of the sheet can be prevented.

The transparent adhesive layer 12 may also be formed with a thermosetting resin mixed with the thermoplastic resin.

Generally, a thermosetting resin has a higher hardness and higher heat resistance (higher adhesive force at high temperature) than those of a thermoplastic resin. Therefore, adding a thermosetting resin into the thermoplastic resin improves in heat resistance while the level of adhesiveness is maintained due to lower residual stress derived from the thermoplastic resin. Further, the hardness of the transparent adhesive layer 12 can be enhanced moderately.

At a portion where transparency is not needed, the transparent electrode 11 can be formed with a conductive coating material including such as carbon, nickel, etc., a low electric resistance coating material such as silver, etc., or an auxiliary electrode made of metallic foil as well as the electroconductive polymers.

As the light-transmitting adhesive layer 12 provided on the reverse side of the transparent electrode layer 11, an adhesive having an excellent adhesiveness to the electroconductive polymer is used as a binder. The binder is preferably different from a binder used for the dielectric layer 14. Examples of such adhesive binders are polyester resins, acrylic resins, cyanoacrylate resin, ethylene-vinyl acetate resins. These resins can be homopolymers or copolymers. Further, synthetic rubbers such as urethane base elastomers, butyl-rubber etc., can also be used. These polymers can be used as a single material or in combination of two or more of them.

As the light-emitting layer 13, EL luminescent material covered by moisture-proof material and dispersed in the binder is used. EL luminescent material covered by thin moisture-proof material such as aluminum oxide, titanium oxide, silicon oxide, etc., is dispersed in the binder. Preferably, the thickness of the layer is in the range of 0.5 to 50 μm.

As the binder for the light-emitting layer 13, fluororesin, polyester resin, acrylic resin, etc., as well as cyanoethylated compound represented by cellulosic resin can be used. Homopolymers and copolymers can be used. These polymers can be used as a single material or in combination thereof. Among these polymers, polyester resin and acrylic resin can be preferably used because these polymers are excellent in such properties as adhesiveness because they are excellent in self-adhesiveness, low moisture absorbance, high reliability of adhesiveness and insulation property. Furthermore, they have a low dielectric constant so that the electric capacitance of the light-emitting layer can be made lower and also driving load at the time when light is emitted can be made smaller. In addition, the glass-transition temperature is comparatively low so that they are flexible and show an excellent moldability, being desirable. Thickness of the light-emitting layer 13 is preferably within the range of about 0.5 to 50 μm.

Luminous efficiency of the dielectric layer 14 provided on the reverse side of the light-emitting layer 13 can be increased when a high dielectric substance such as barium titanate, titanium oxide, potassium titanate, etc., is dispersed in the binder. As the binder, any binders exemplified above that can be used for the light-emitting layer 13 can be used. Specifically, the same binder which is used for the light-emitting layer 13 can be used. Another binder can also be used as far as it is selected from the exemplified ones. Fluorcarbon resin binders have an excellent hydrophobic property so that they can preferably be used, too.

The counter electrode layer 15 provided on the reverse side of the dielectric layer 14 is preferably formed by electroconductive coating material which is a product made by dispersing an electroconductive filler in a resin solution. As the electroconductive filler, elementary metal such as gold, silver, copper, nickel, etc., or alloyed metal including such elementary metal can be used. Other than such metal, carbon black, graphite, etc., can also be used. As the resin in the resin solution, epoxy type resin, urethane type resin, acrylic resin, polyester type resin, silicone resin, etc., can be exemplified. Such resins can be homopolymers or copolymers. These polymers can be used as a single material or in combination.

Into at least one of the light-transmitting adhesive layer 12, the light-emitting layer 13 and the dielectric layer 14, ion-exchange material is preferably dispersed. Especially, when cyanoethyl type binder is used as the binder, the ion-exchange material traps ions in the layer, effectively suppressing an unexpected movement of the ions.

Ion-exchange material can be classified into three categories—cationic, anionic and amphoteric ion-exchange material. Cationic or amphoteric materials are preferably used in the present invention. Zirconium type, antimony type, bismuth type material, etc., can be exemplified as a preferable ion-exchange material.

The amount of ion-exchange material introduced into each layer is within the range of 0.1 to 15% by mass, preferably 1 to 10% by mass based on the amount including the binder and the ion-exchange material. Under 1% by mass, sufficient ion trapping effect can not be given. On the contrary, over 10% by mass, dielectric constant of the layer begins undesirably decreasing.

On at least the reverse side of the sheet-like light-emitting portion 5 which comprises the transparent electrode layer 11, the light-transmitting adhesive layer 12, the light-emitting layer 13, the dielectric layer 14 and the counter electrode layer 15, the adhesive layer 16 is provided. The adhesive layer 16 is preferably made of resin or rubber. The film adhesive layer 16 is used to enhance adhesiveness to the core material 3 made of resin.

The core material 3 of the key top portion 4 can be made of flexible or rigid resin, elastomer, silicone rubber, etc. The core material 3 can also be made of thermoplastic resin or thermosetting resin. Preferably polycarbonate type resin is exemplified.

The core material 3 is, for example, formed substantially into the shape of cylinder, elliptic cylinder or square rod.

Between the reverse side of the transparent insulation film 10 and the transparent electrode layer 11, for example, colored ink is applied partially. A desired colored pattern can be realized when colored ink is used.

The EL sheet obtained according to the above mentioned structure was subjected to an adhesiveness test using a cross-cut method (Japanese Industrial Standard, JIS K-5600-5-6: Coating Material General Test Procedures—Unit 5: Mechanical Property of Coated Material Section 6: Adhesive Property). The light-emitting layer 13 using fluorobinder was directly laminated on the transparent electrode layer 11 to obtain an EL sheet. The adhesiveness between the layers was turned out to be poor. On the other hand, an EL sheet obtained using the light-transmitting adhesive layer 12 between the transparent insulation film 10 and the transparent electrode layer 11, and between the transparent electrode layer 11 and the light-emitting layer 13 made of fluoro binder, showed an improved adhesiveness. In addition, adhesiveness was further improved when a polyester type or an acrylic type binder was used as a binder of the light-emitting layer 13.

The member for lighting a push-button switch 1 mentioned above can be manufactured, for example, as follows.

For example, the transparent insulation film 10 is flatly positioned as a base sheet and then transparent electrode layer 11 is formed in the shape of a strip on the film 10 using a printing machine. The width of the transparent electrode layer 11 is made about equal to that of the upper surface of the key top portion 4, and the position of the layer 11 should be entirely adjusted to that of the key top portion 4 of the film 10.

On the transparent electrode layer 11, the light-transmitting adhesive layer 12 is formed using a screen printer. The light-emitting layer 13 is formed on the layer 12 at a place necessary for emitting light. Luminous ink is used for the light-emitting layer 13.

On the light-emitting layer 13, the dielectric layer 14 is applied, and then the counter electrode layer 15 having about the same size of the light-emitting layer 13 is printed on the layer 14. Further, on the layer 15, the film adhesive layer 16 is printed. Thus the EL sheet 2 is obtained.

The thus obtained EL sheet 2 is subjected to a drawing process by a pneumatic, vacuum molding or a compression molding after it is loaded in a prescribed cavity of a convex-concave mold having a desired shape of the key top portion 4. The EL sheet is molded into a shape protruding toward the transparent insulation film 10 side and has a concave portion on the side of the film adhesive layer 16. The core material 3 made of polycarbonate type resin, for example, is filled into the concave portion. Thus the member for lighting a push-button switch 1, which has a resistance to delamination between the transparent electrode layer 11 and the light-emitting layer 13, can be obtained.

Examples will be described hereunder.

Example 1

According to the embodiment described above, an EL sheet 2 and the member for lighting a push-button switch 1 was provided as follows.

Bayfol (a product by Bayer AA), an alloy film made of polycarbonate type resin having 125 μm thickness, was prepared and used as the transparent insulation film 10, which is used as an outermost layer. A colored ink as an decorative layer was applied on the film 10 by screen printing.

On the colored ink-applied film, a polyester type ink IPS-000 (a product by Teikoku Printing Inks Mfg. Co., Ltd.), was applied using a screen printing as the light-transmitting adhesive layer 12. Then an electro-conductive polymer, Orgacon P3040 (a product by Agfa), was applied by screen printing as the transparent electrode layer 11.

On the transparent electrode layer 11, a polyester type ink, IPS-000 (a product by Teikoku Printing Inks Mfg. Co., Ltd.) was applied by screen printing as the light-transmitting adhesive layer 12.

Further, into the same polyester type ink IPS-000 (a product by Teikoku Printing Inks Mfg. Ltd.), which was used as the transparent adhesive layer 12, an EL luminescent material IGS430 (a product by Osram Sylvania) which is coated by moisture-proof material was dispersed and then applied by screen printing as the light-emitting layer 13 on a position of the layer 12 from where light is emitted.

On the light-emitting layer 13, a dielectric coating material comprising a fluororesin (Viton A, a product by Dupont Dow Elastomer) dissolved in methyl ethyl ketone (MEK), an organic solvent and barium titanate (BT100P, a product by Fuji Titanium Industry Co., Ltd.) dispersed in the coating material was applied as the dielectric layer 14 by screen printing.

On the dielectric layer 14, silver paste ED6022SS (a product by Acheson Industries) as a counter electrode 15 was applied by screen printing. Thus an EL sheet 2 was obtained.

After coating of the counter electrode layer 15, a polycarbonate type ink Noriphan HTR (a product by Proll KG.) was printed as the film adhesive layer 16 on a portion of the EL sheet 2 where the resin of the core material 3 contacts.

The EL sheet 2, which was provided with the film adhesive layer 16, was mounted on a mold having a key top configuration and was subjected to a drawing process at 120° C. Then into the concave portion of the drawn EL sheet 2, polycarbonate resin as the core material was injection-molded.

Even when the EL sheet is molded into a three dimensional shape, each layer of the EL sheet 2 could comfortably change its shape into a designed configuration so that no delamination could occur between any layers, being able to obtain a member for lighting a push-button switch 1 having no such problems as disconnection, non-light emission or black dot phenomena.

Example 2

In the same manner as described in Example 1, an EL sheet 2 and a member for lighting a push-button switch 1 was produced as follows.

Bayfol (a product by Bayer AG), an alloy film made of polycarbonate resin having 125 μm thickness, was used as the transparent insulation film 10, which is used as an outermost layer. A colored ink was applied on the film 10 by screen printing.

On the colored ink-applied film, an electroconductive polymer, Orgacon P3040 (a product by Agfa), was applied by screen printing as the transparent electrode layer 11.

On a portion of the transparent electrode layer 11, where light is emitted, the light-emitting layer 13 was formed by wet process. Into a polyester type medium EG-000Medium (a product by Teikoku Printing Inks Mfg. Co., Ltd.) as a binder, EL luminescent material GGS22 (a product by Osram Sylvania) was mixed at the ratio of 1:1, obtaining an ink for the light-emitting layer.

On the light-emitting layer 13 which was applied by screen printing, an insulation paste 8153N EL Insulation Paste (a product by Dupont) as the dielectric layer 14 was applied by screen printing.

On the dielectric layer 14, electroconductive paste, 7152 EL Carbon Paste (a product by Dupont) was applied as a counter electrode layer 15 by screen printing. Thus the EL sheet 2 was obtained.

After coating of the counter electrode layer 15, a polycarbonate type ink (Noriphan HTR, a product by Proll KG) was printed as the film adhesive layer 16 at a portion of the EL sheet 2 where the resin of the core material 3 contacts to the EL sheet 2.

The EL sheet 2, which is provided with the film-adhesive layer 16 was mounted on a mold having a key top configuration and was subjected to a drawing process at 120° C. Then into the concave portion of the drawn EL sheet 2, polycarbonate resin as the core material was injection-molded.

Thus a member for lighting a push-button switch 1 was obtained with no phenomena of delamination between the transparent electrode 11 and the light-emitting layer 13 even after the drawing process.

Example 3

Example 3 was carried out under same condition as in Example 1 except that a composition having fluororesin, barium titanate dispersed in the fluororesin and 5% by mass of amphoteric ion-exchange resin IXE-633 (antimony-bismuth type, a product by Toagosei Co., Ltd.) was applied as the dielectric layer 14 by screen printing.

Thus obtained member for lighting a push-button switch 1 showed an excellent moisture resistance.

Example 4

Example 4 was carried out under same condition as in Example 2 except that a composition having the insulation past 8153N EL Insulation Paste (a product by Dupont) and 5% by mass of amphoteric ion-exchange resin IXE 600 (antimony-bismuth type, a product by Toagosei Co., Ltd.) was applied as the dielectric layer 14 by screen printing.

Thus obtained member for lighting a push-button switch 1 showed an excellent durability.

Next, embodiments according to the twenty-sixth through twenty-eighth and forty-second through forty-fourth aspects of the present invention will be explained with reference to FIGS. 3 and 4.

Figure 3:
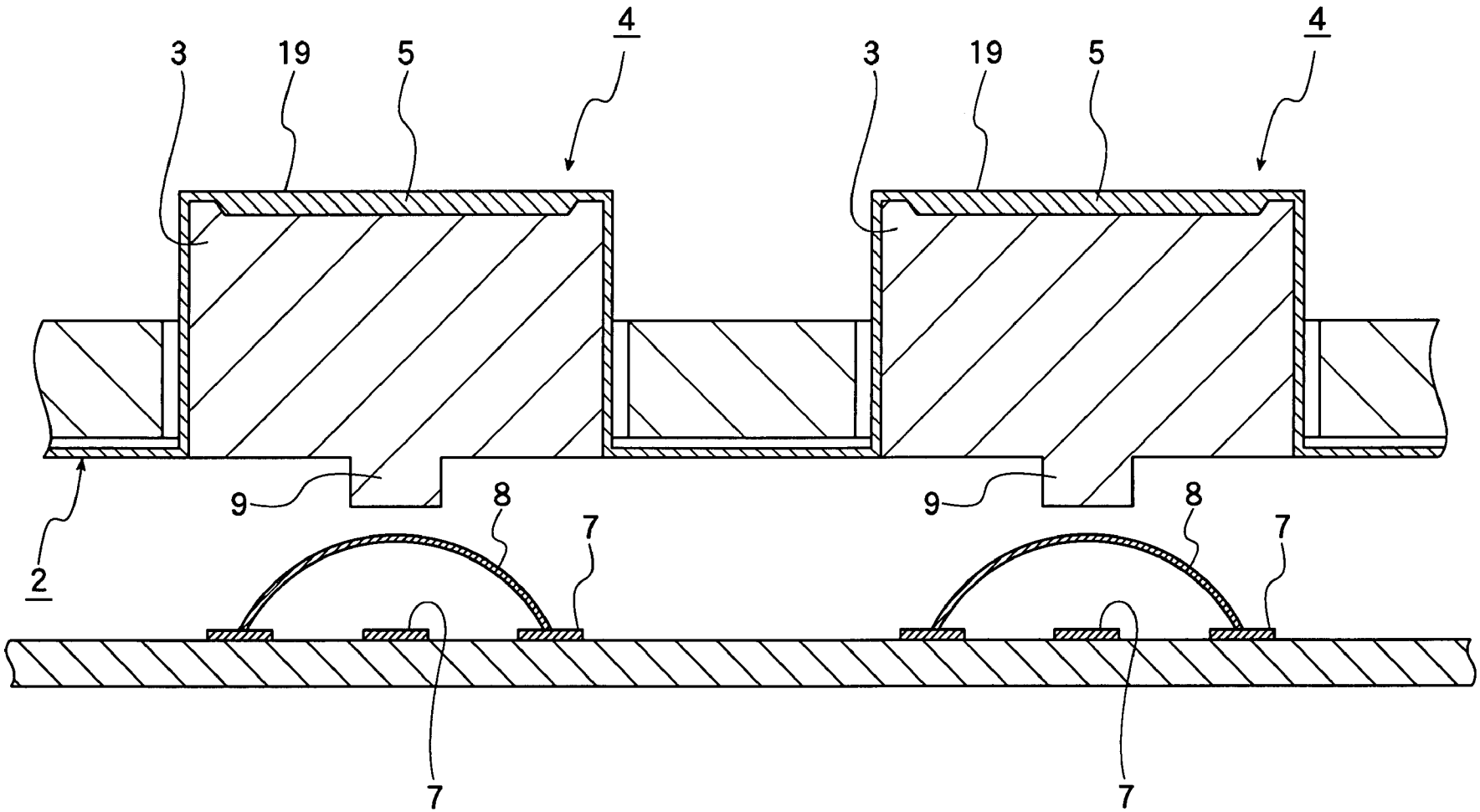
FIG. 3 is a sectional view showing an essential portion of an example of a member for lighting a push-button switch according to the present invention.

FIG. 3 is a sectional view showing an essential portion of a member for lighting a push-button switch 1 in a switch according to the present invention. FIG. 4 is a sectional view showing details of the essential portion of a sheet-like light-emitting portion of FIG. 3.

Figure 4:
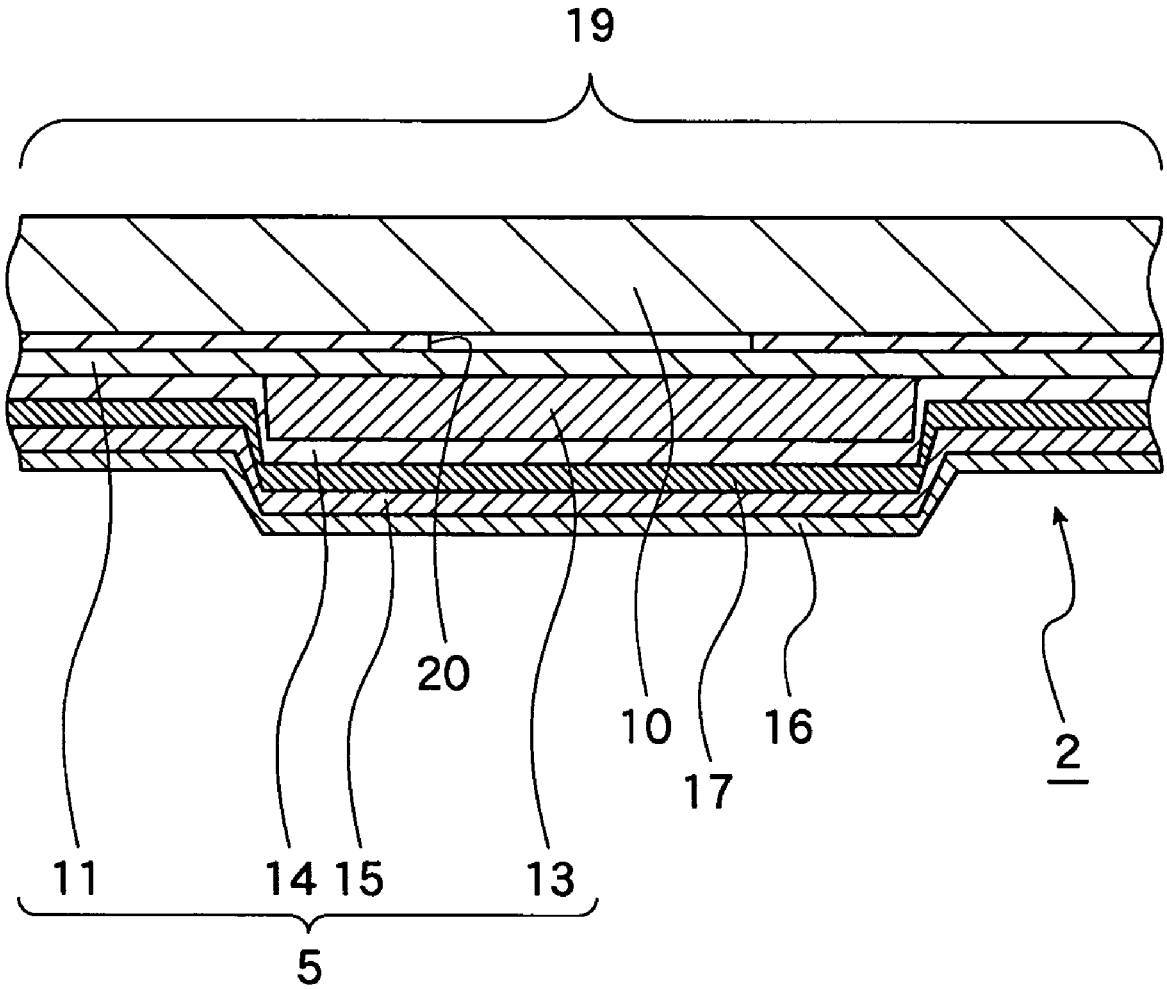
FIG. 4 is a sectional view showing details of the essential portion of a sheet-like light-emitting portion of FIG. 3.

FIG. 4 is a sectional view showing an essential portion of the sheet-like light-emitting portion 5 of the illuminated-type push-button switch member having a second counter electrode layer 17 and/or a second dielectric layer 17 according to the twenty-sixth through twenty-eighth or forty-second through forty-fourth aspects of the present invention.

An EL sheet 2 is made by laminating a transparent insulation film 10 as a sheet-like base material, a decorative layer 20, a transparent electrode layer 11, a light-emitting layer 13, a dielectric layer 14, a counter electrode layer 15 and a protective layer 16 in this order. Between the transparent electrode layer 11 and the counter electrode layer 15, at least one layer of the second counter electrode layer 17 and/or the second dielectric layer 17, which plays a role of ion-diffusion-prevention function, is provided. By using the second counter electrode layer 17 and/or the second dielectric layer 17, the EL sheet 2 shows a good stability in high-temperature and high-humidity circumstances.

At least one layer having a function of preventing impurity ions that comes out of the transparent electrode layer 11 or the counter electrode layer 15, from diffusing is provided between the transparent electrode layer 11 and the counter electrode layer 15. The ion diffusion prevention layer 17 has a function of slowing down the diffusion speed of the impurity ions or trapping the ions, and must be electrically stable per se. If the prevention layer 17 is made of a transparent-colorless or transparent-light colored material, it can be used at a portion between the transparent electrode layer 11 and the light-emitting layer 13. But when the prevention layer 17 is provided at a portion lower than the light-emitting layer 13 or at a portion of the counter electrode layer 15 side, deterioration of the light-emitting material can be effectively prevented without any restrictions on color and transparency of the layer 17.

For example, when material comprising a synthetic resin and an electroconductive filler such as carbon of nickel as a main filler dispersed in the synthetic resin is used as the second counter electrode layer 17 between the dielectric layer 14 and the counter electrode layer 15, passage or diffusion of the impurity ions which come out of the transparent electrode layer 11 or the counter electrode layer 15 can be prevented, being able to prevent insulation deterioration and maintain light-emitting reliability for a long time. Further, when the synthetic resin is used more, by parts by mass, than the electroconductive filler in the second counter electrode layer 17, or when 3~50 parts by mass of the conductive filler is used for 100 parts by mass of the solid content, the second counter electrode layer 17 can have an excellent moldability. Electrically stable carbon or nickel can preferably used as the conductive filler. Small amount of other metal, however, can be used together in order to reduce electric resistance.

As the synthetic resin, polyester type, acrylic type, urethane type, fluoro type, silicone type and epoxy type resins can be exemplified. These resins can be a homopolymer or a copolymer, and can be used solely or in combination. Among these resins, fluoro type resin or epoxy type resin can be preferably used because of their low moisture absorbance.

In order to minimize a decrease in luminous efficiency and to strengthen the insulation properties, the second dielectric layer 17 made by dispersing a dielectric substance into the synthetic resin can be provided in contact with the dielectric layer 14. By setting the dielectric constant of the second dielectric layer 17 lower than that of the dielectric layer 14, passage or diffusion of impurity ions which comes out of the transparent electrode layer 11 or the counter electrode layer 15, can be prevented, being able to prevent insulation deterioration and maintain light-emitting reliability for a long time, though the luminous efficiency is somewhat sacrificed. Such efficiency or properties can be realized by controlling the amount of dielectric substance to be added into the synthetic resin or can be realized by using the dielectric substance or synthetic resin having low dielectric constant.

As for the amount of dielectric substance to be added, addition of small amount of dielectric substance into the synthetic resin can give a function of preventing diffusion of the ions. However, when the amount of the dielectric substance is simply reduced, the insulation properties of the second dielectric layer 17 increases and electrical stability increases, but intensity of the electric field on the light-emitting layer decreases. Therefore it is desirable to make the thickness of the layer thinner so that the layer can maintain a certain electric capacitance level.

On the contrary, when the amount of the dielectric substances in 100 parts by mass of the total solid content of the second dielectric layer 17 exceeds 70 parts by mass, ductility of the second dielectric layer 17 decreases. Therefore, the second dielectric layer can not change its shape smoothly in response to a change of the film when molded, causing a crack or disconnection and decrease in brightness or non-light emission. When 40 to 60 parts by mass of the dielectric substance in 100 parts by mass of the total solid content of the second dielectric layer 17 is dispersed in a synthetic resin, the second dielectric layer 17 shows good moldability, and influence caused from variation in thickness of the layer can be made small.

Similar material for the dielectric layer 14 can be used for the second dielectric layer 17. But when the amount of the dielectric substance to be added is intentionally made smaller than that of the dielectric layer 14, passage or diffusion of impurity ions which come out of the transparent electrode layer 11 or the counter electrode layer 15 can be prevented, being able to prevent insulation deterioration and maintain light-emitting reliability for a longtime.

When titanium oxide or the like, which has a higher insulation properties is preferably used as the dielectric substance, insulation properties between the transparent electrode layer 11 and the counter electrode layer 15 can preferably be increased. The insulation properties and the dielectric constant are opposed to each other. The dielectric constant of the second dielectric layer 17 is preferably about less than 70% of that of the dielectric substance used in the dielectric layer 14. Furthermore, impurity ions can be effectively trapped by adding ion-exchange material.

As a synthetic resin which composes the dielectric layer, polyester type, acrylic type, urethane type, fluoro type, silicone type or polyepoxy type resins can be exemplified. These resins can be a homopolymer or a copolymer and can be used as a single material or in combination thereof. Fluoro type resin or the like having a low moisture absorption ratio can be preferably used.

The second dielectric layer 17 can be composed solely of a synthetic resin without adding the dielectric substance. As is the case with the second dielectric layer 17 including dielectric substance, the electric resistance of the second dielectric layer 17 made only of synthetic resin increases and the dielectric constant decreases too when the thickness of the layer is made thick. Therefore it is desirable to make the layer 17 thinner. In order to achieve effective ion exchange diffusion-prevention function, it is necessary to make the film even or uniform. Practically the thickness of the layer is within the range of about 0.1 to 10 μm. The layer 17 can be provided at a place next to the dielectric layer 14. When a transparent and colorless resin is used, the layer can be provided between the transparent electrode layer 11 and the light-emitting layer 13.

These ion diffusion-prevention layer 17 can be used singly or plurally, in accordance with the intended use.

The thus obtained unmolded EL sheet 2 was placed on a concave mold which is shaped into a key top configuration through cutting procedure so that the transparent insulation film 10 is faced to an opposite side of the mold, and then molded into a desired key top shape by a pneumatic molding, vacuum molding, compression molding, etc., obtaining an intermediary molded product of the member for lighting a push-button switch 1. Next, thermoplastic resin, thermosetting resin, light curing resin, electron beam-curing resin, reaction type curing resin, etc., was injected into the concave portion which is the reverse side of the key top portion 4 and cured, obtaining the member for lighting a push-button switch 1. Other method such as fitting a core material 3 into the molded EL sheet 2 may be adopted.

Examples will be explained hereunder.

Example 5

According to the embodiment described above, a member for lighting a push-button switch 1 was provided.

A polycarbonate-made alloy film having 125 μm thickness (Bayfol, a product by Bayer) was used as the transparent insulation film 10. The decorative layer 20 was screen-printed on the film using a colored ink (Noriphan HTR, a product by Proll KG). On the reverse side of the decorative layer 20, a light-transmitting adhesive layer (IPS 000, a product by Teikoku Printing Inks Mfg. Co., Ltd.) was screen-printed and then an electroconductive polymer (Orgacon P3040, a product by Agfa) as the transparent electrode layer 11 was screen-printed thereon. Next, an auxiliary electrode layer (a circuit) was screen-printed using a silver paste (JEF-6022SS, a product by Japan Acheson Industries) on a portion other than the emitting region of the transparent electrode layer 11. On the transparent electrode layer 11, a medium ink (JELCON AD-HM6, a product by Jujo Chemical Co., Ltd.) was screen-printed as an adhesive layer. Then a luminous ink (8155N EL Medium Ink, a product by DuPont) was screen-printed at a portion needed to be illuminated as the light-emitting layer 13. A dispersion liquid, having a solution comprising fluoro rubber (Daiel G501, a product by Daikin Industries, Ltd.) dissolved in methyl ethyl ketone and barium titanate (BT100P, a product by Fuji Titanium Industry Co., Ltd.) having dielectric constant of 1200 dispersed in the solution with the amount of 250 parts by mass of barium titanate based on the basis of 100 parts by mass of fluoro rubber, was screen-printed as the dielectric layer 14. The second counter electrode layer 17 was screen-printed to be an average thickness of 3 μm using an EL carbon paste (7152 EL Carbon Paste, a product by DuPont). Further, the counter electrode layer 15 was screen-printed thereon using a silver paste (JEF-6022SS, a product by Japan Acheson Industries). Further, the film adhesive layer 16 was printed using a PC type ink (Noriphan HTR, a product by Proll KG). Thus an unmolded EL sheet 2 was obtained.

The thus obtained EL sheet 2 was placed on a concave mold which was shaped into a key top configuration through cutting process so the transparent insulation film 10 was positioned on the mold side, and then press-molded at 120° C. for 15 seconds.

After the EL sheet 2 was molded, a polycarbonate type resin (Iupilon, a product by Mitsubishi Engineering-Plastics Corporation) was injection-molded into the inside of the key top portion 4 to form the core material 3, obtaining a member for lighting a push-button switch 1.

Alternating voltage was applied to the thus obtained members for lighting a push-button switch member 1 to make the members emit light. It was confirmed that a plurality of the key top portions 4 evenly emitted light because an increase in the electrode resistance caused from molding processes was effectively suppressed. A value of 105 cd/m$^2$ was observed as an initial luminance under a constant-voltage power supply of 100V, 400 HZ.

The obtained members for lighting a push-button switch member 1 was subjected to a continuous emitting test under a high-temperature and high-humidity environment at 60° C., 95% humidity under the constant-voltage supply of 100V, 400 Hz. A black dot was first observed after 576 hours from the start of the test. Generally durability time period of the member for lighting a push-button switch 1 is usually required more than 240 hours under various environment. Therefore the switch member 1 can fully meet such requirement.

Example 6

Example 6 was carried out in the same manner as in Example 5 and subjected to the same test method except that the second dielectric layer 17 was used instead of the second counter electrode layer 17.

In Example 6, the second dielectric layer 17 having an average thickness of 3 μm was screen-printed using a dispersion liquid having a fluoro rubber (Daiel G501, a product by Daikin Industries Ltd.), methyl ethyl ketone and titanium oxide having a dielectric constant of 100. Titanium oxide was dispersed in the liquid with a ratio of titanium oxide to the fluoro rubber of 50 parts by mass:100 parts by mass.

Example 7

Example 7 was carried out in the same manner as in Example 5 and subjected to the same test method except that the second counter electrode layer 17 and the second dielectric layer 17 were further provided.

In Example 7, the second dielectric layer 17 having an average thickness of 3 μm was provided by screen printing using a dispersion liquid having fluoro rubber (G501, a product by Daikin Industries Ltd.), methyl ethyl ketone and titanium oxide dispersed in the liquid with a ratio of 50:100 parts by mass of titanium oxide to the fluoro rubber. Further the second counter electrode layer 17 having an average thickness of 3 μm was screen-printed using a carbon paste (7152 EL Carbon Paste, a product by DuPont).

Example 8

Example 8 was carried out in the same manner as in Example 5 and subjected to the same test method except the dielectric layer 17.

In Example 8, the second dielectric layer 17 having an average thickness of 3 μm was screen-printed using a solution of fluoro rubber (G501, a product by Daikin Industries Ltd.) dissolved in methyl ethyl ketone.

Comparative Example 1

Comparative Example 1 was carried out in the same manner as in Example 5 and subjected to the same test method except the material of the second dielectric layer 17.

In Comparative Example 1, a layer having an average thickness of 3 μm was provided by screen-printing using the same material as the dielectric layer 14, instead of the second dielectric layer 17.

Comparative Example 2

Comparative Example 2 was carried out in the same manner as in Example 5 and subjected to the same test method except that the ion diffusion prevention layer 17 was not used.

In comparative Example 2, the member for lighting a push-button switch 1 was provided without using a layer having a ion diffusion-prevention function, which is used for preventing diffusion of ion from the second counter electrode layer and the second dielectric layer.

The obtained member for lighting a push-button switch members in Examples 5 to 8 and Comparative Examples 1 to 2 were subjected to the same performance test as in Example 5. The results are shown in Table 1.

TABLE 1

| | Example 5 | Example 6 | Example 7 | Example 8 | Comparative Example 1 | Comparative Example 2 |
|---|---|---|---|---|---|---|
| Ion diffusion-preventing layer | Carbon paste | Titanium oxide | Titanium oxide and Carbon paste | Fluoro rubber | None (Two dielectric layers) | None |
| Initial luminance [cd/m$^2$] | 105 | 85 | 79 | 52 | 91 | 110 |

TABLE 1-continued

| | Example 5 | Example 6 | Example 7 | Example 8 | Comparative Example 1 | Comparative Example 2 |
|---|---|---|---|---|---|---|
| At the time when black dot appears [hr] | after 576 | after 600 | after 696 | after more than 1000 | after 120 | after 72 |

From the results of Examples 5 to 8 in Table 1, the switch members having higher initial luminance have a tendency to have a shorter period of time during which a black dot appears. However, for Examples 5 to 8, the black dot was not appeared within 240 hours from the start of the continuous lighting. Members for lighting a push-button switch having high reliability even under a hot and high humidity environment were obtained. Material for the ion diffusion preventing layer 17 should be selected in view of the above mentioned characteristics and other requirements required for its intended-applications, structural restrictions such as clearance or height of the product, operating conditions, etc.

On the other hand, in members for lighting push-button switch without the ion diffusion-preventing layer in Comparative Examples 1 and 2, the black dot appeared within 240 hours from the start of lighting.

REFERENCE NUMERALS

Reference numerals used in FIGS. 1~4 are shown below.

1 Member for lighting push-button switch
2 EL sheet
3 Core Material
4 Key top portion
5 Sheet-like light-emitting portion
6 Circuit board
7 Fixed contact
8 Disc spring
9 Pressing protrusion
10 Transparent insulation film (Sheet base material)
11 Transparent electrode layer
12 Light-transmitting adhesive layer
13 Light-emitting layer
14 Dielectric layer
15 Counter electrode layer
16 Film adhesive layer
17 Ion diffusion-preventing layer (Second counter electrode layer or
18 Second dielectric layer)
19 Upper surface portion
20 Decorative layer

What is claimed is:

1. An EL sheet comprising:
a counter electrode layer;
a dielectric layer;
a light-emitting layer;
a transparent electrode layer made of an electroconductive polymer; and
a sheet base member,
wherein a light-transmitting adhesive layer is disposed between the transparent electrode layer made of the electroconductive polymer and the light-emitting layer, the light-transmitting adhesive layer having adhesiveness with respect to the electroconductive polymer, and
wherein the EL sheet has a three-dimensional shape.

2. An EL sheet according to claim 1, wherein the light-transmitting adhesive layer is a first light-transmitting adhesive layer, the EL sheet further comprising:
a second light-transmitting adhesive layer disposed between the transparent electrode layer made of the electroconductive polymer and the sheet base member, the second light-transmitting adhesive layer having adhesiveness with respect to the electroconductive polymer.

3. An EL sheet according to claim 1, wherein fluororesin is used as a binder for at least one of the dielectric layer and the light-emitting layer.

4. An EL sheet according to claim 1, wherein a polyester-base resin or an acrylic resin is used as a binder for the light-emitting layer, and fluorineresin is used as a binder for the dielectric layer.

5. An EL sheet according to claim 1, wherein an ion-exchange material is dispersed in at least one of the counter electrode layer, the dielectric layer, the light-emitting layer, the transparent electrode layer made of electroconductive polymer and the light-transmitting adhesive layer, wherein the ion-exchange material is a cationic or an amphoteric material, and wherein the ion-exchange material is a zirconium type, antimony type or bismuth type material.

6. An EL sheet according to claim 5, wherein, for each layer in which the ion-exchange material is dispersed, an amount of the ion-exchange material is more than 1% and less than 10% by mass.

7. A member for lighting a push-button switch comprising:
an EL sheet according to claim 1, a portion of the EL sheet being formed into a convex shape projecting from a rear side near the counter electrode layer to a top side near the transparent electrode layer; and
a core material having a key top shape being filled into a concave portion of the rear side of the convex shape.

8. An EL sheet according to claim 1, wherein the counter electrode layer comprises a first counter electrode layer, the EL sheet further comprising:
at least one second counter electrode layer disposed between the transparent electrode layer and the first counter electrode layer, the second counter electrode layer comprising a synthetic resin and a conductive filler which comprises nickel or carbon as a main conductive ingredient and is dispersed in the synthetic resin, the second counter electrode layer being disposed in contact with the first counter electrode layer.

9. An EL sheet according claim 1, wherein the dielectric layer comprises a first dielectric layer, the EL sheet further comprising:
at least one second dielectric layer disposed between the transparent electrode layer and the counter electrode layer, the second dielectric layer comprising a synthetic resin and a dielectric substance having a dielectric constant lower than that of a dielectric substance used in the first dielectric layer, the second dielectric layer being disposed in contact with the first dielectric layer.

10. An EL sheet according to claim 1, wherein the counter electrode layer comprises a first counter electrode layer and the dielectric layer comprises a first dielectric layer, the EL sheet further comprising:

at least one second counter electrode layer disposed between the transparent electrode layer and the first counter electrode layer, the second counter electrode layer comprising a synthetic resin and a conductive filler which comprises nickel or carbon as a main conductive ingredient and is dispersed in the synthetic resin, the second counter electrode layer being disposed in contact with the first counter electrode layer; and at least one second dielectric layer disposed between the transparent electrode layer and the second counter electrode layer, the second dielectric layer comprising a synthetic resin and a dielectric substance having a dielectric constant lower than that of a dielectric substance used in the first dielectric layer, the second dielectric layer being disposed in contact with the first dielectric layer.

11. An EL sheet according to claim 1, wherein a binder for the light-emitting layer is different from that of the dielectric layer and the electroconductive polymer, the binder for the light-emitting layer having adhesiveness with respect to the electroconductive polymer.

12. An EL sheet according to claim 11, further comprising:

a light-transmitting adhesive layer disposed between the transparent electrode layer made of the electroconductive polymer and the sheet base member, the light-transmitting adhesive layer having adhesiveness with respect to the electroconductive polymer.

13. An EL sheet according to claim 11, wherein the binder for the light-emitting layer is at least one resin-base binder selected from a group consisting of a polyester-base binder, an acrylic binder, a cyanoacrylate-base binder and an ethylene-vinyl acetate-base binder, or a synthetic rubber-base binder represented by urethane.

14. An EL sheet according to claim 11, wherein a fluororesin is used as a binder for the dielectric layer.

15. An EL sheet according to claim 11, wherein an ion-exchange material is dispersed in at least one of the counter electrode layer, the dielectric layer, the light-emitting layer and the transparent electrode layer made of electroconductive polymer, wherein the ion-exchange material is a cationic or an amphoteric material, and wherein the ion-exchange material is a zirconium type, antimony type or bismuth type material.

16. An EL sheet according to claim 15, wherein, for each layer in which the ion-exchange material is dispersed, an amount of the ion-exchange material is more than 1% and less than 10% by mass.

17. An EL sheet according to claim 11, wherein the counter electrode layer comprises a first counter electrode layer, the EL sheet further comprising:

at least one second counter electrode layer disposed between the transparent electrode layer and the first counter electrode layer, the second counter electrode layer comprising a synthetic resin and a conductive filler which comprises nickel or carbon as a main conductive ingredient and is dispersed in the synthetic resin, the second counter electrode layer being disposed in contact with the first counter electrode layer.

18. An EL sheet according to claim 11, wherein the counter electrode layer comprises a first counter electrode layer and the dielectric layer comprises a first dielectric layer, the EL sheet further comprising:

at least one second counter electrode layer disposed between the transparent electrode layer and the first counter electrode layer, the second counter electrode layer comprising a synthetic resin and a conductive filler which comprises nickel or carbon as a main conductive ingredient and is dispersed in the synthetic resin, the second counter electrode layer being disposed in contact with the first counter electrode layer; and at least one second dielectric layer disposed between the transparent electrode layer and the second counter electrode layer, the second dielectric layer comprising a synthetic resin and a dielectric substance having a dielectric constant lower than that of a dielectric substance used in the first dielectric layer, the second dielectric layer being disposed in contact with the first dielectric layer.

19. An EL sheet comprising:

a counter electrode layer;

a dielectric layer;

a light-emitting layer;

a transparent electrode layer made of an electroconductive polymer; and a sheet base member, wherein at least one resin-base binder selected from a group consisting of a polyester-base binder, an acrylic binder, a cyanoacrylate-base binder and an ethylene-vinyl acetate-base binder or a synthetic rubber-base binder represented by urethane is disposed between the transparent electrode layer made of electroconductive polymer and the light-emitting layer, and wherein the EL sheet has a three-dimensional shape.

20. An EL sheet according to claim 19, further comprising:

at least one resin-base binder selected from a group consisting of a polyester-base binder, an acrylic binder, a cyanoacrylate-base binder and an ethylene-vinyl acetate-base binder or a synthetic rubber-base binder represented by urethane disposed between the transparent electrode layer made of electroconductive polymer and the sheet base member.

21. An EL sheet according to claim 20, wherein a polyester-base resin or an acrylic resin is used as a binder for the light-emitting layer, and a fluororesin is used as a binder for the dielectric layer, and an ion-exchange material is dispersed in at least one of the counter electrode layer, the dielectric layer, the light-emitting layer, the transparent electrode layer made of electroconductive polymer and the light-transmitting adhesive layer, wherein the ion-exchange material is a cationic or an amphoteric material, and wherein the ion-exchange material is a zirconium type, antimony type or bismuth type material.

22. An EL sheet according to claim 21, wherein, for each layer in which the ion-exchange material is dispersed, an amount of the ion-exchange material is more than 1% and less than 10% by mass.

23. An EL sheet according to claim 19, wherein a binder for the light-emitting layer is different from that of the dielectric layer and the electroconductive polymer, the binder for the light-emitting layer having adhesiveness with respect to the electroconductive polymer.

* * * * *